US009867753B2

(12) United States Patent
Garay-Arauz

(10) Patent No.: US 9,867,753 B2
(45) Date of Patent: Jan. 16, 2018

(54) JAW EXERCISER

(71) Applicant: Alexis Garay-Arauz, Scarborough (CA)

(72) Inventor: Alexis Garay-Arauz, Scarborough (CA)

( * ) Notice: Subject to any disclaimer, the term of this patent is extended or adjusted under 35 U.S.C. 154(b) by 0 days.

(21) Appl. No.: 14/876,320

(22) Filed: Oct. 6, 2015

(65) Prior Publication Data

US 2016/0101315 A1 Apr. 14, 2016

Related U.S. Application Data

(60) Provisional application No. 62/061,196, filed on Oct. 8, 2014.

(51) Int. Cl.

| | |
|---|---|
| ***A63B 23/025*** | (2006.01) |
| ***A63B 23/03*** | (2006.01) |
| ***A61H 1/00*** | (2006.01) |
| ***A61H 1/02*** | (2006.01) |

(52) U.S. Cl.

CPC ..... *A61H 1/02* (2013.01); *A61H 2201/0192* (2013.01); *A61H 2201/1253* (2013.01); *A61H 2201/149* (2013.01); *A61H 2205/026* (2013.01)

(58) Field of Classification Search

CPC ..... A61H 1/00; A61H 1/02; A61H 2205/026; A61H 22/01; A61H 22/12; A61H 22/1253; A61H 2201/14; A61H 2201/1481; A61H 2201/149; A63B 23/025; A63B 23/03; A63B 23/032; A61B 17/7013; A61B 17/7014; A61B 17/7016; A61B 17/7017; A61B 17/7052; A61B 17/1604; A61B 17/1606; A61B 17/1608; A61B 17/1611; A61B 17/1673

See application file for complete search history.

(56) References Cited

U.S. PATENT DOCUMENTS

| | | | | | |
|---|---|---|---|---|---|
| 742,698 | A | | 10/1903 | Mason | |
| 1,401,190 | A | * | 12/1921 | Risley | A61B 1/24 600/215 |
| 3,547,433 | A | | 12/1970 | Robins | |
| 3,721,439 | A | | 3/1973 | Rudolph | |
| 3,813,096 | A | | 5/1974 | Welch | |
| 3,938,508 | A | * | 2/1976 | Buckner | A61F 5/00 128/859 |
| 4,185,817 | A | | 1/1980 | Peterson | |
| 4,280,696 | A | | 7/1981 | Ramon | |

(Continued)

*Primary Examiner* — Nyca T Nguyen

(74) *Attorney, Agent, or Firm* — Heer Law; Christopher D. Heer

(57) ABSTRACT

A jaw exerciser for providing passive motion therapy such as that used to treat trismus is provided. The jaw exerciser has a user-adjustable distance between the upper jaw support and the lower jaw support. The jaw exerciser includes a shaft, a first or upper jaw support frame including a first jaw support, a second or lower jaw support frame including a second jaw support, a distance adjuster which may be in the form of a jack screw for manually adjusting the distance between the first jaw support and the second jaw support, and a retaining screw. The jack screw may be received by the second or lower jaw support frame and engage the first or upper jaw support frame. Removable bite pads may optionally be provided for installing on the first jaw support and the second jaw support.

3 Claims, 18 Drawing Sheets

(56) References Cited

U.S. PATENT DOCUMENTS 4,883,046 A 11/1989 Fontenot
4,909,502 A 3/1990 Beeuwkes, III et al.
4,946,165 A * 8/1990 Rambacher ..... A63B 69/0075 473/419
5,035,420 A 7/1991 Beeuwkes, III et al.
5,097,820 A 3/1992 Shulman
5,374,237 A 12/1994 McCarty, Jr.
1,851,865 A 7/1995 Miller
5,431,610 A 7/1995 Miller
5,462,435 A 10/1995 Young
5,582,560 A 12/1996 Magnuson
5,746,703 A * 5/1998 Levatino ..... A63B 23/032 482/11
5,846,212 A 12/1998 Beeuwkes, III et al.
5,919,116 A * 7/1999 Edell ..... A63B 21/055 482/11
6,361,475 B1 3/2002 Jobe
6,406,405 B1 * 6/2002 Chu ..... A63B 23/032 482/11
6,413,231 B1 7/2002 Berman et al.
7,059,332 B2 6/2006 Eli
7,238,145 B2 * 7/2007 Robbins ..... A63B 21/0004 482/11
7,438,667 B2 10/2008 Robbins
7,476,180 B1 1/2009 Cobb
8,307,745 B2 11/2012 Christensen
2003/0088158 A1 * 5/2003 Chien ..... A63B 23/032 600/237
2006/0201520 A1 * 9/2006 Christensen, III ..... A61C 5/14 128/848
2007/0012319 A1 1/2007 Frascati
2007/0089752 A1 * 4/2007 Christensen, III ... A61H 1/0218 128/845
2011/0190072 A1 * 8/2011 Beach ..... A63B 53/02 473/307
2012/0142498 A1 6/2012 Li
2014/0018710 A1 1/2014 Israel
2015/0251051 A1 * 9/2015 Mohammed ..... A63B 23/032 482/11

* cited by examiner

JAW EXERCISER

FIELD OF THE INVENTION

The present specification relates generally to jaw exercisers and more specifically relates to a passive motion therapy jaw exerciser having a user-adjustable distance between the upper jaw support and lower jaw support.

BACKGROUND OF THE INVENTION

Certain ailments or treatments of ailments may cause patients to lose range of motion in their jaw as well as diminish their jaw and joint function. The inability to open one's mouth fully is a condition referred to as trismus (sometimes referred to as "lockjaw"). For patients with trismus, jaw motion may be partially or fully rehabilitated by passive motion therapy in which the jaw muscles are passively stretched, i.e. without activating jaw muscles to perform the movement. This can be accomplished by the patients using their hands to pull their lower jaw open and holding the stretch for a predetermined duration, for example, 30 seconds. Over time, the patient gradually opens his or her mouth further and further thereby increasing the range of motion of his or her jaw.

Certain devices are available to assist with passive motion therapy so that the user need not use their hands to hold their jaw open, but instead may use their hands for other activities while maintaining their jaw in a passive stretched position. Such devices may include upper and lower jaw supports in which the distance between the upper and lower jaw supports is adjustable. As passive range of motion stretching may be done, for example, 10 times per day, the patient may wish to take the device with them outside of the home. However, presently available devices are bulky and typically involve the use of separate carrying cases to transport them while not in use. Some patients may find transporting such devices inconvenient and may choose not to take them outside of the home. This may reduce the frequency with which they perform the passive stretching exercises and consequently slow their rehabilitation process.

Accordingly, there remains a need for improvements in the art.

SUMMARY OF THE INVENTION

In accordance with an aspect of the invention, there is provided a compact passive motion therapy jaw exerciser that may be quickly assembled and disassembled and thereby may be conveniently carried on one's person, such as in a jacket or pant pocket, without the need for a separate carrying case.

According to an embodiment of the invention, the present invention provides a jaw exerciser comprising: a shaft; a first jaw support frame in sliding frictional engagement with the shaft and extending substantially perpendicularly to the shaft, the first jaw support frame including a first jaw support; a second jaw support frame in sliding frictional engagement with the shaft and extending substantially perpendicularly to the shaft, the second jaw support frame including a second jaw support; and a distance adjuster received by the first jaw support frame and engaging the second jaw support frame so as to be substantially parallel to the shaft, the distance adjuster being configured to adjust the distance between the first jaw support and the second jaw support.

According to a further embodiment, the present invention provides a kit for assembling a jaw exerciser, the kit comprising: a shaft; a first jaw support frame including a first jaw support, the first jaw support being configured to slidingly frictionally engage the shaft; an adjustable second jaw support frame including a second jaw support, the adjustable second jaw support being configured to slidingly frictionally engage the shaft; and a jack, the jack being configured to engage the first jaw support frame and be received by the adjustable second jaw support frame so as to be substantially parallel to the shaft and to adjust the distance between the first jaw support and the second jaw support.

According to a further embodiment, the present invention provides a method for assembling a jaw exerciser, the method comprising: positioning a first jaw support frame including a first jaw support, on a shaft in sliding frictional engagement; positioning an adjustable second jaw support frame including a second jaw support, on the shaft in sliding frictional engagement; engaging a retaining screw with the shaft to prevent the first jaw support frame and the adjustable second jaw support frame from disengaging from the shaft; and engaging a jack with the first jaw support frame through the adjustable second jaw support frame, the jack for adjusting the distance between the first jaw support and the second jaw support.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicate like or corresponding elements in the drawings.

DETAILED DESCRIPTION OF THE EMBODIMENTS

Figure 1:
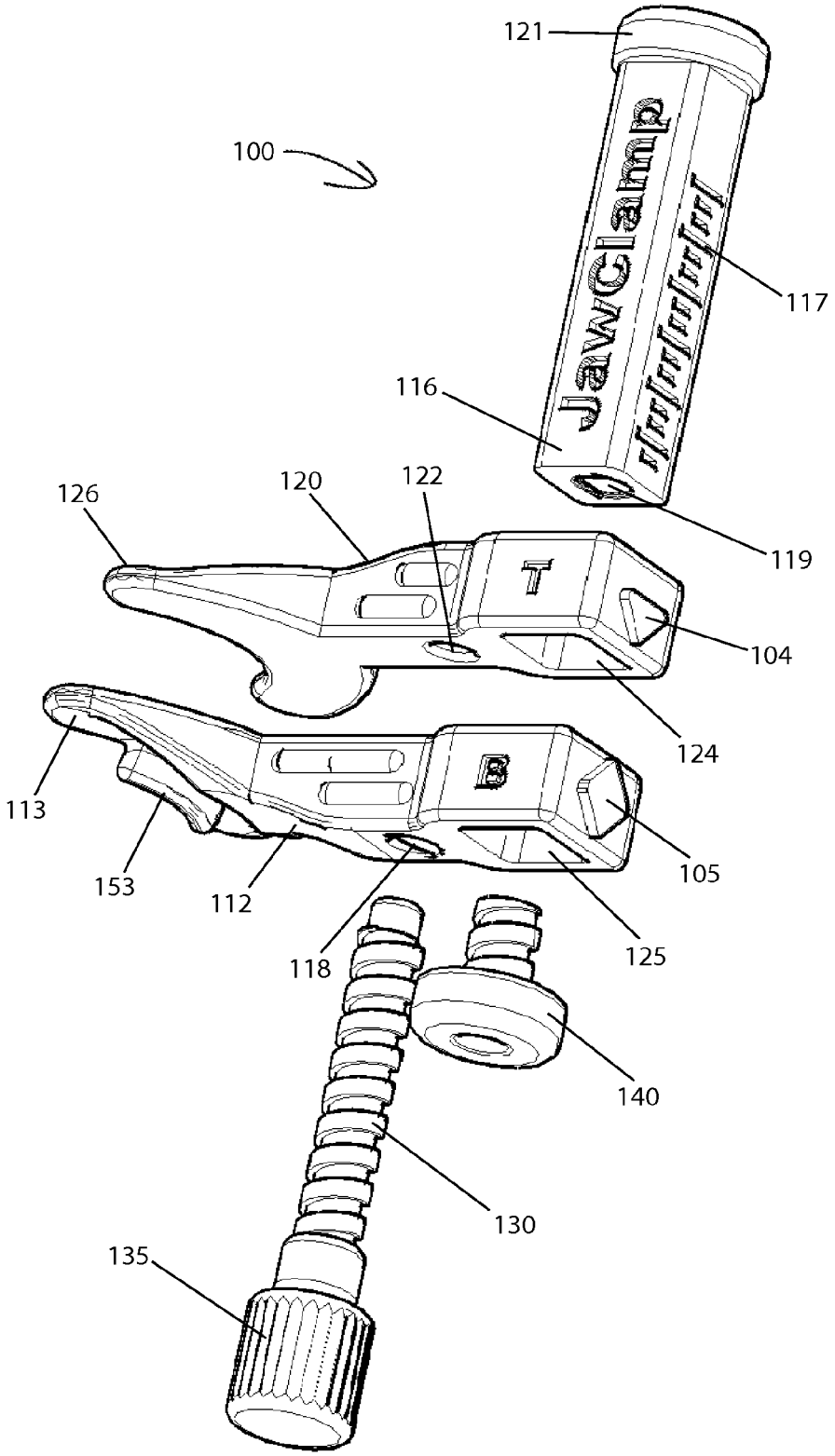
FIG. 1 is an exploded view of a jaw exerciser according to an embodiment.
Figure 2A:
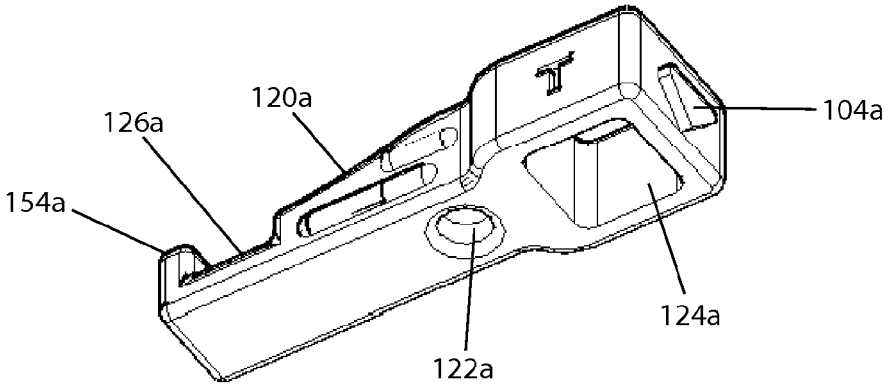
FIG. 2A is a bottom right side perspective view of a straight first jaw support according to an embodiment and FIG. 2B is a top right side perspective view of the straight first jaw support of FIG. 2A.
Figure 2B:
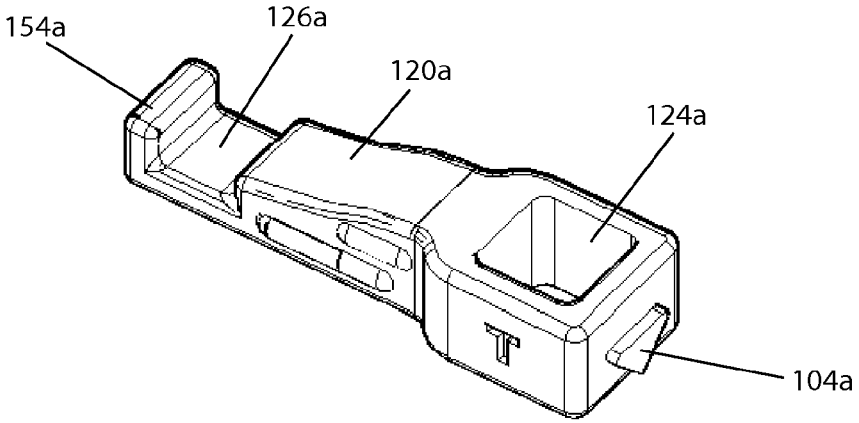
Figure 3A:
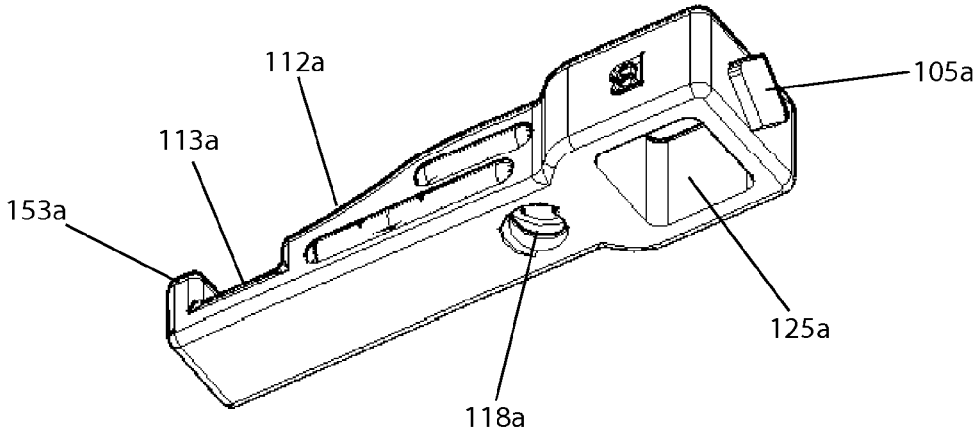
FIG. 3A is a top left side perspective view of a straight second jaw support according to an embodiment and FIG. 3B is a bottom left side perspective view of the straight second jaw support of FIG. 3A.
Figure 3B:
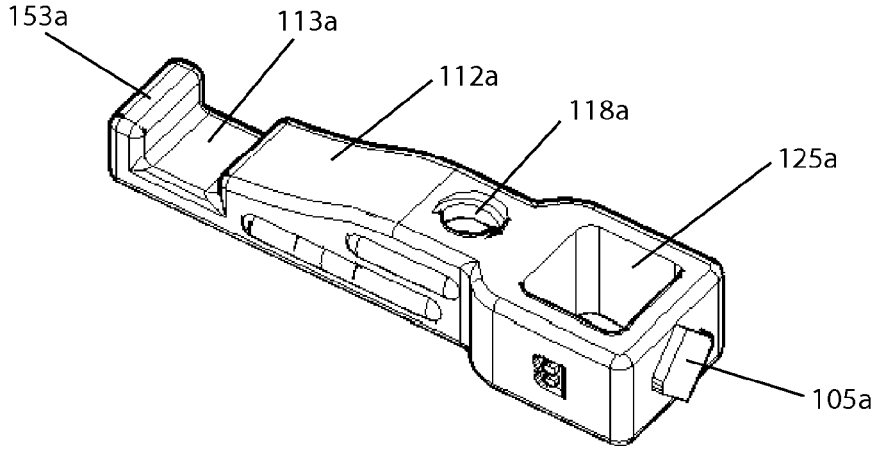
Figure 4A:
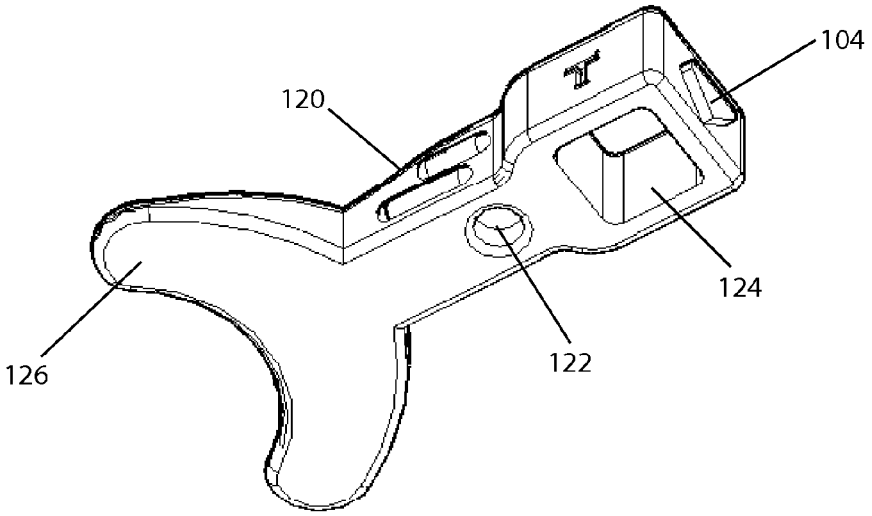
FIG. 4A is a bottom right side perspective view of an arched first jaw support according to an embodiment and FIG. 4B is a top right side perspective view of the arched first jaw support of FIG. 4A.
Figure 4B:
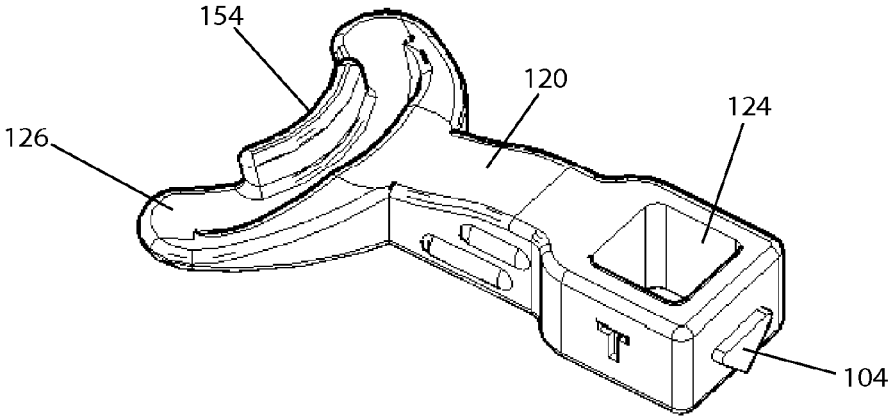
Figure 5A:
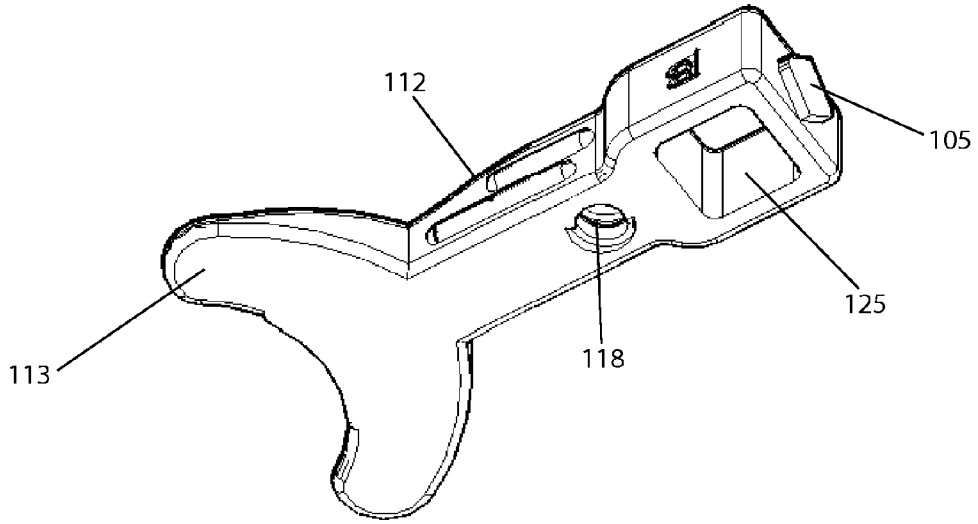
FIG. 5A is a top left side perspective view of an arched second jaw support according to an embodiment and FIG. 5B is a bottom left side perspective view of the arched second jaw support of FIG. 5A.
Figure 5B:
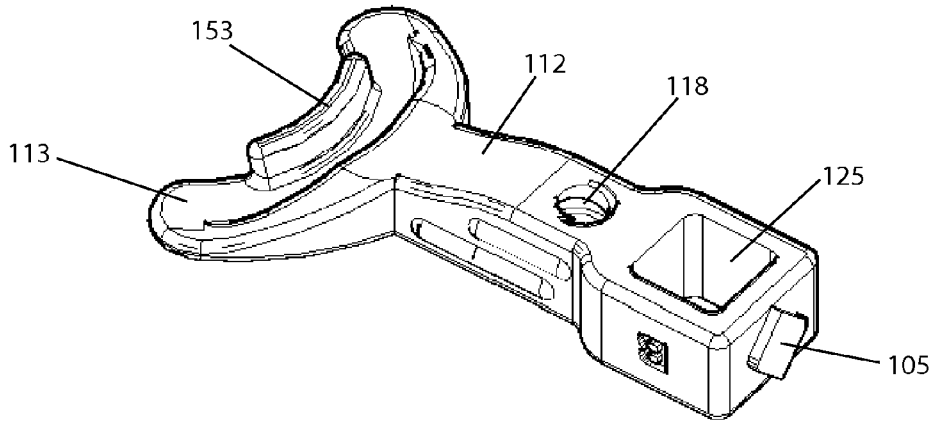
Figure 6A:
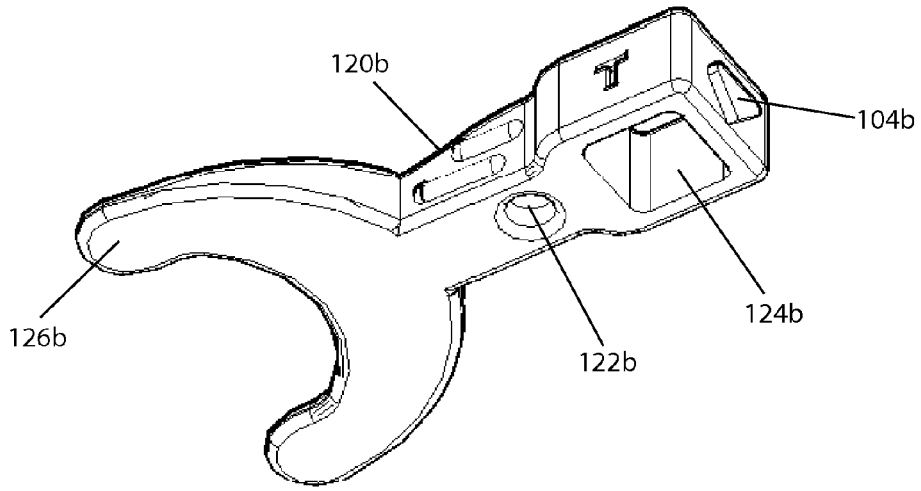
FIG. 6A is a bottom right side perspective view of an extended arched first jaw support according to an embodiment and FIG. 6B is a top right side perspective view of the extended arched first jaw support of FIG. 6A.
Figure 6B:
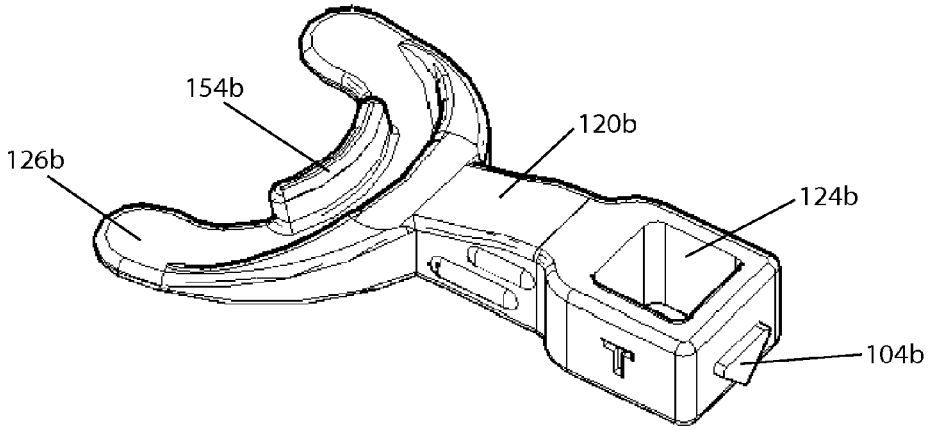
Figure 7A:
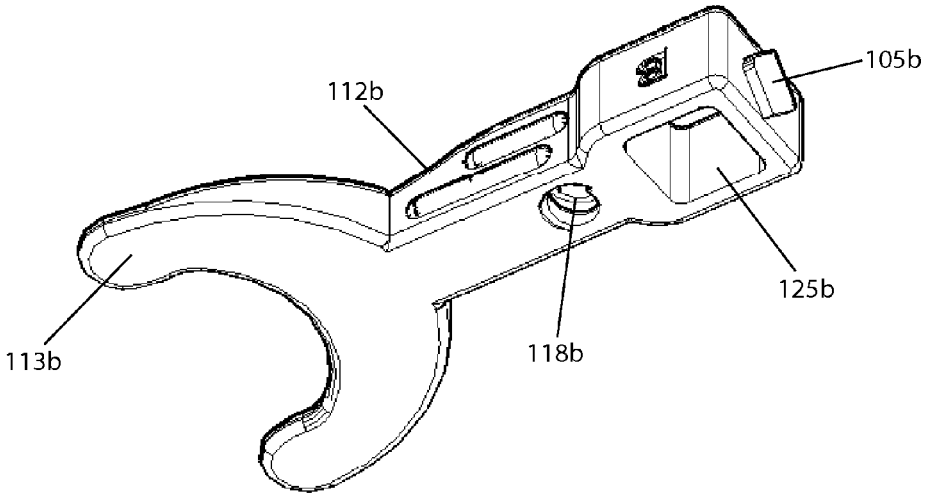
FIG. 7A is a top left side perspective view of an extended arched second jaw support according to an embodiment and FIG. 7B is a bottom left side perspective view of the extended arched second jaw support of FIG. 7A.
Figure 7B:
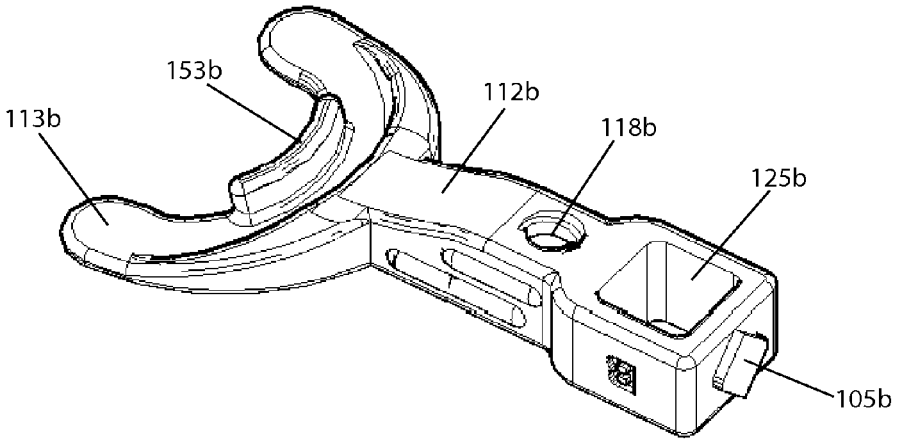

According to an embodiment as shown in FIGS. 1, 12A, 12B, 13A, and 13B, a jaw exerciser such as jaw exerciser 100 is generally configured to allow a user, namely a human, to use passive motion therapy to exercise his or her jaw. The jaw exerciser 100 may comprise a shaft 116, a first jaw support frame 120 in sliding frictional engagement with the shaft 116, an adjustable second jaw support frame 112 in sliding frictional engagement with the shaft 116 and a distance adjuster such as a jack, for example, a jack screw 130 which may be received by, engage or connect to the first jaw support frame 120 and also engage the second jaw support frame 112 so as to be substantially parallel to the shaft 116. The first jaw support frame 120 may include a first jaw support 126 and the second jaw support frame 112 may include a second jaw support 113, each jaw support 126 and 113 being for insertion into a user's mouth. The distance adjuster such as jack screw 130 may be configured to adjust the distance between the first jaw support 126 and the second jaw support 113 using a knob 135 included at the top of the jack screw 130. According to an embodiment, turning the knob 135 in a first direction lowers the adjustable second jaw support frame 112 thereby increasing the distance between the first jaw support 126 and the second jaw support 113, while turning the knob 135 in the opposite direction to the first direction lowers the jack screw 130 thereby allowing the user to push the adjustable second jaw support frame 112 towards the first jaw support frame 120 in order to reduce the distance between the first jaw support 126 and the second jaw support 113.

Figure 10A:
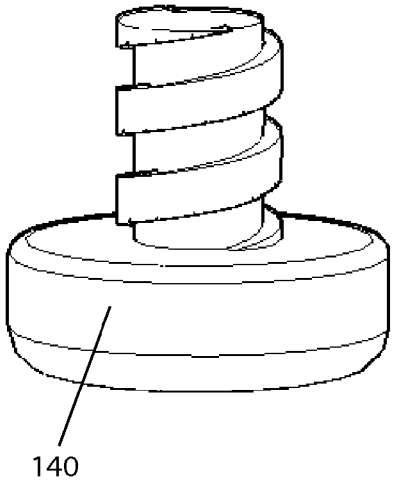
FIG. 10A is a front view of the retaining screw of the jaw exerciser of FIG. 1 according to an embodiment and FIG. 10B is a bottom front perspective view of the retaining screw of FIG. 10A.
Figure 10B:
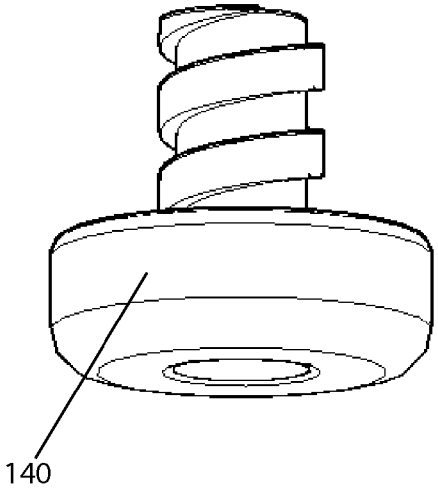
Figure 11A:
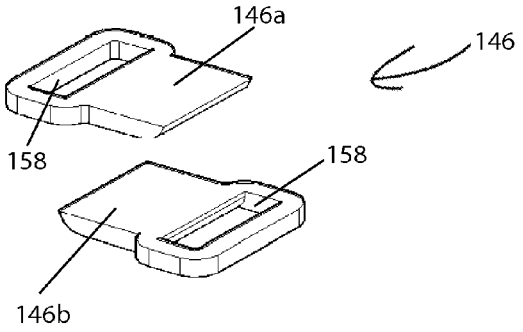
FIG. 11A is a top perspective view of a pair of straight bite pads according to an embodiment.
Figure 11B:
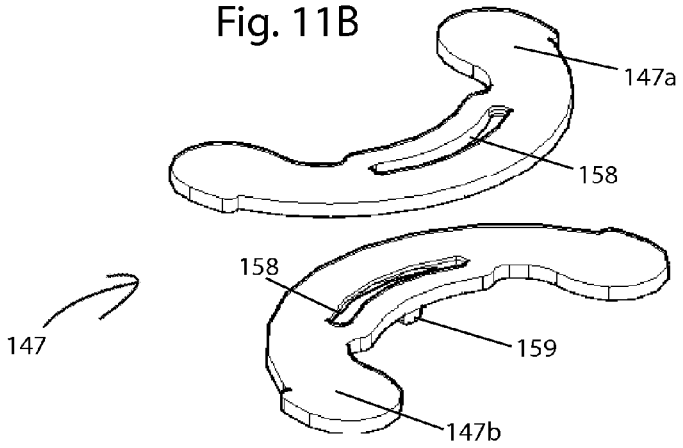
FIG. 11B is a top perspective view of a pair of extended arched bite pads according to an embodiment.
Figure 11C:
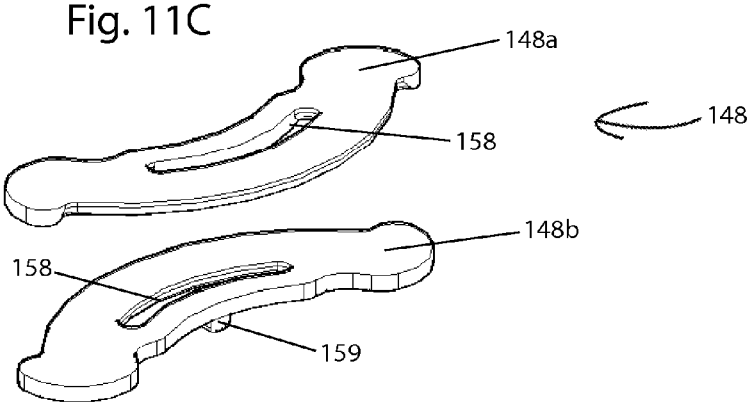
FIG. 11C is a top perspective view of a pair of arched bite pads according to an embodiment.
Figure 11D:
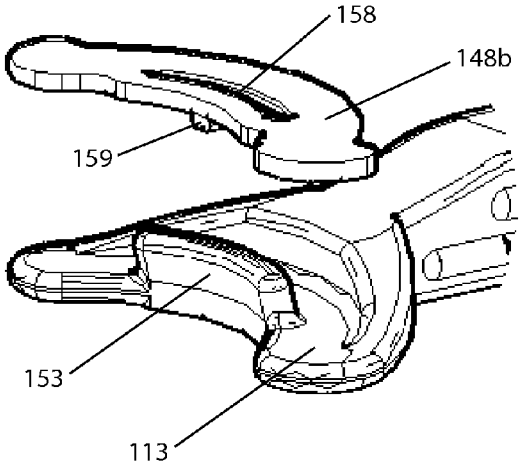
FIG. 11D is a bottom left side perspective view of the arched bite pad of FIG. 11C shown separated prior to being installed on the arched jaw support.
Figure 11E:
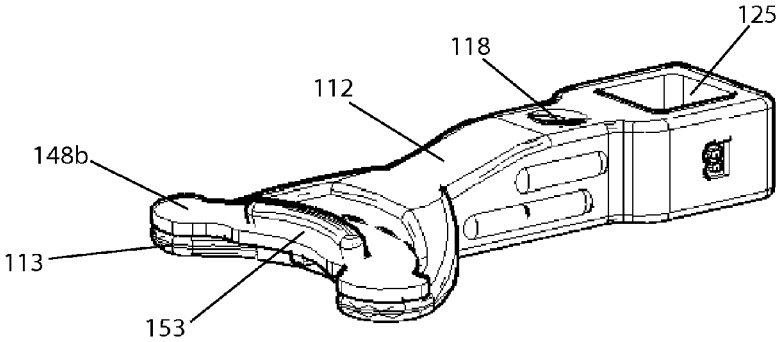
FIG. 11E is a bottom left side perspective view of the arched bite pad shown installed on the arched jaw support.
Figure 12A:
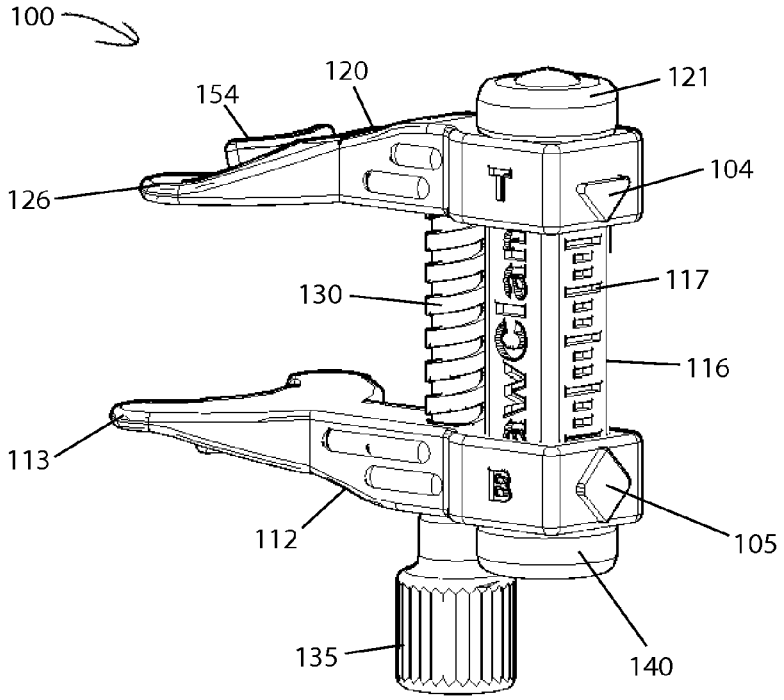
FIG. 12A is a back right side perspective view of the jaw exerciser of FIG. 1 in an open position according to an embodiment and FIG. 12B is front right side perspective view of the jaw exerciser of FIG. 12A in an open position.
Figure 12B:
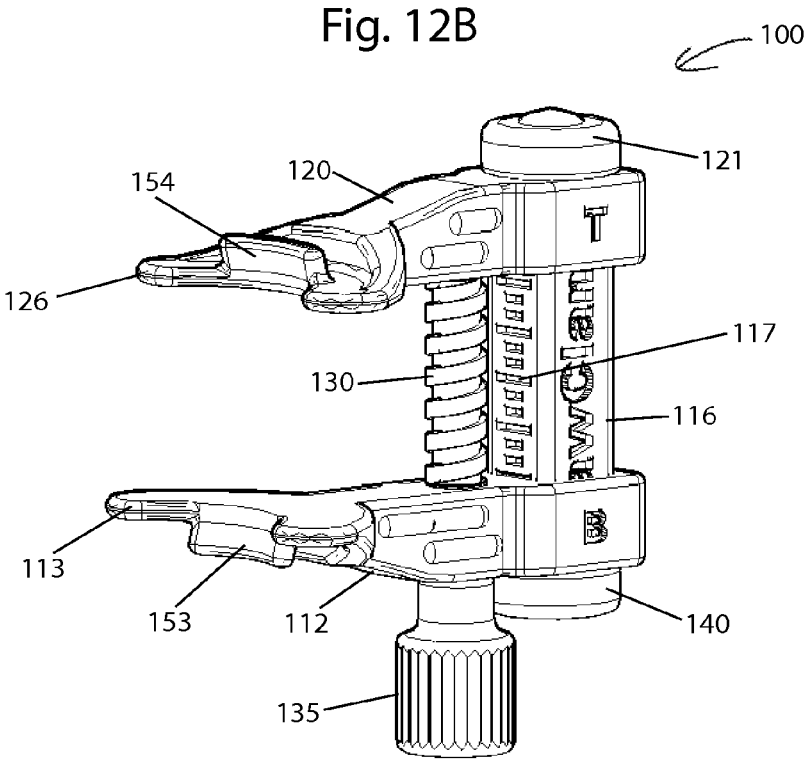
Figure 13A:
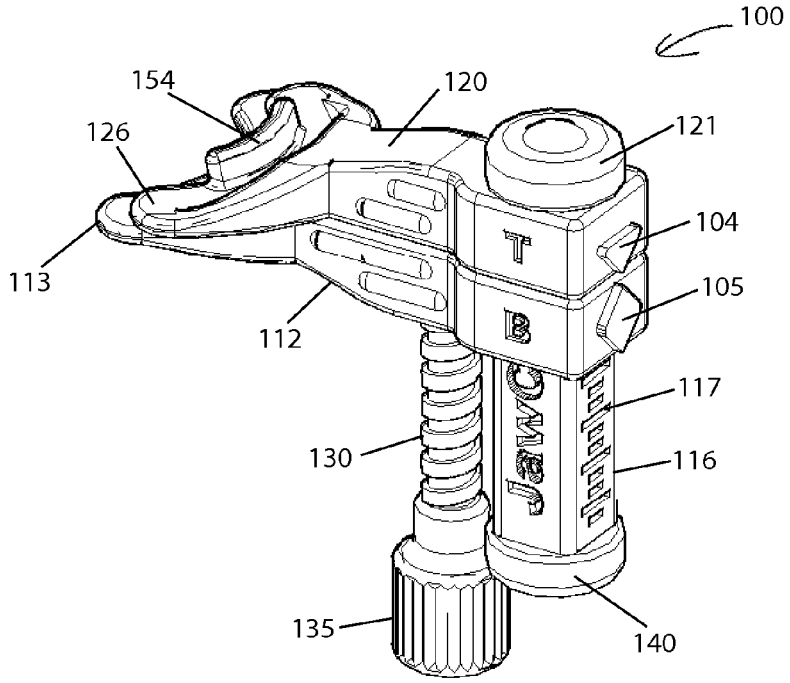
FIG. 13A is a top right side perspective view of the jaw exerciser of FIG. 1 in a closed position according to an embodiment and FIG. 13B is a bottom left side perspective view of the jaw exerciser of FIG. 13A in a closed position.
Figure 13B:
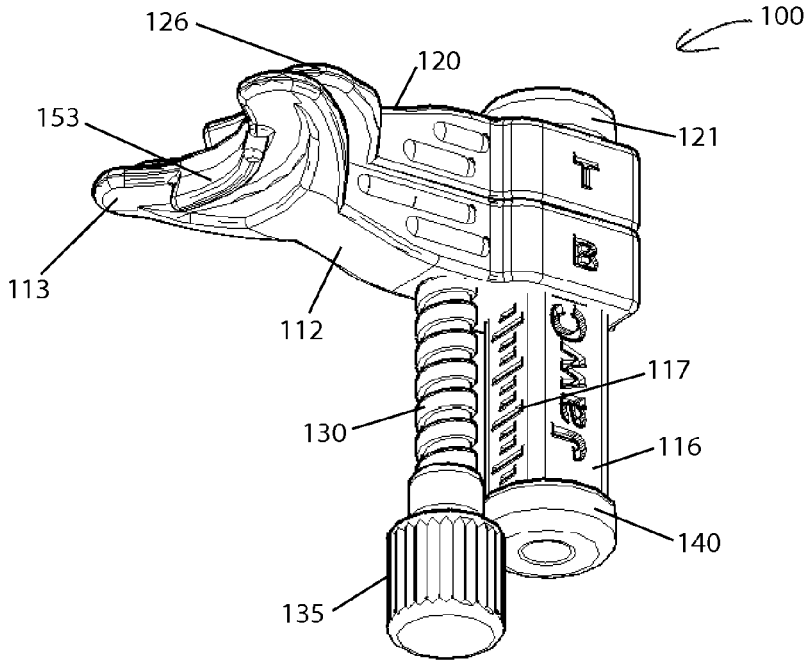

According to an embodiment, the jaw exerciser may also include a retaining means such as retaining screw 140. According to an embodiment as shown in FIGS. 10A and 10B, the retaining screw 140 may be removable such that temporarily removing it may allow the first jaw support frame 120 and the second jaw support frame 112 to be placed on, or removed from, the shaft 116, during assembly or disassembly of the jaw exerciser 100. According to an embodiment, a retaining cap 121 may be provided on shaft 116 to prevent the first jaw support frame 120 and the second jaw support frame 112 from disengaging with shaft 116. According to an embodiment, retaining cap 121 may be integrally molded with the shaft 116. According to an embodiment, a scale such as distance scale 117 may be provided on the shaft 116 that visually conveys the distance between the first jaw support frame 120 and the second jaw support frame 112. According to an embodiment, each line on the distance scale 117 may be 2 mm from the next line. According to an embodiment, an indicator 104 may be provided on the first jaw support frame 120 and an indicator 105 may be provided on the second jaw support frame 112 to help the user differentiate between the first and second jaw support frames. According to an embodiment, indicators 104 and 105 may be shapes such as an inverted triangle and a diamond. According to a further embodiment, letters, such as T for top and B for bottom may be used as indicators 104 and 105. According to a further embodiment, both shapes and letters may be used as indicators 104 and 105.

Figure 8A:
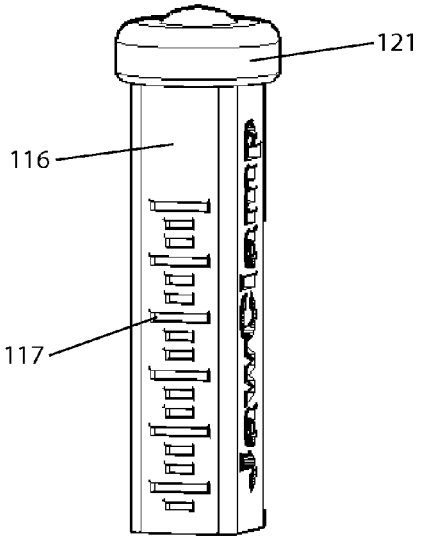
FIG. 8A is a back perspective view of the mini-sized shaft of the jaw exerciser of FIG. 1.
Figure 8B:
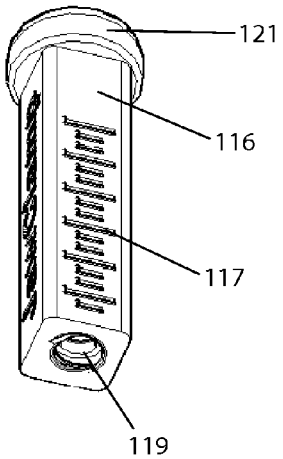
FIG. 8B is a bottom left side perspective view of the mini-sized shaft of FIG. 8A.
Figure 8C:
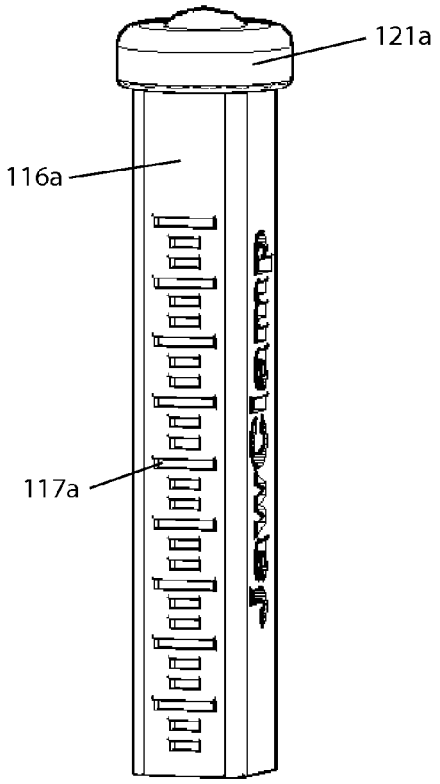
FIG. 8C is a back right perspective view of a shaft according to another embodiment and FIG. 8D is a bottom left side perspective view of the shaft of FIG. 8C.
Figure 8D:
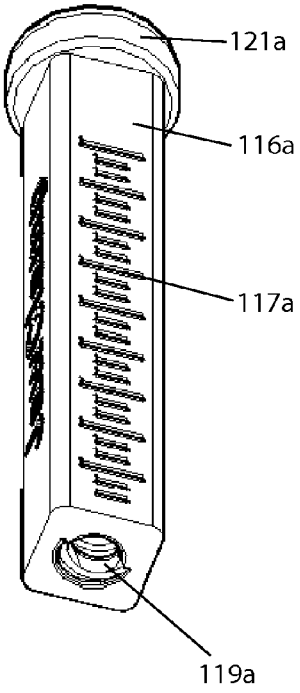
Figure 9A:
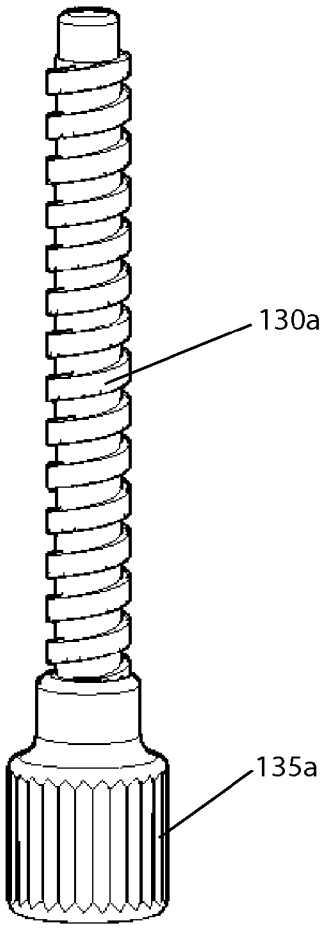
FIG. 9A is a front view of a jack according to an embodiment and FIG. 9B is a front view of the mini-sized jack of the jaw exerciser of FIG. 1.
Figure 9B:
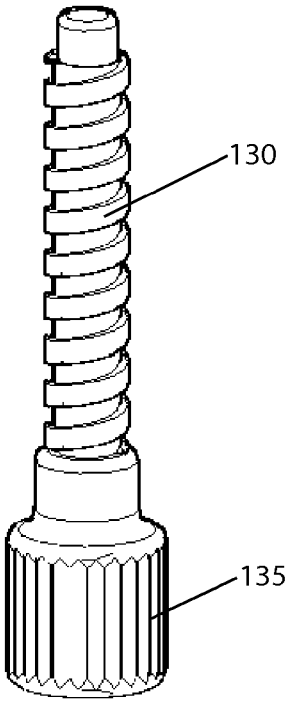

According to different embodiments of the invention, the maximum distance between the first jaw support 126 and the second jaw support 113 may vary in order to accommodate users with different jaw sizes. For example, one embodiment of the jaw exerciser using shaft 116 and jack 130 as shown in FIGS. 8C, 8D, and 9A, may, for example, open up to 53.4 mm (2.1 inches) wide (a "standard" size), while another embodiment of the jaw exerciser using mini-sized shaft 116*a* and mini-sized jack 130*a* as shown in FIGS. 8A, 8B, and 9B, may, for example open up to 33.4 mm (1.3 inches) wide (a "mini" size). Note that FIGS. 8A, 8B, and 9B denote corresponding parts 116, 117, 119, 121, 130, and 135 in a mini-sized shaft and jack to the parts 116*a*, 117*a*, 119*a*, 121*a*, 130*a*, and 135*a* of the standard-sized shaft and jack. Other maximum distances are possible according to further embodiments of the invention; for example, a mini-sized version may suitably support a maximum distance of between about 10 mm and about 33.4 mm.

According to the embodiments as shown in FIGS. 2A to 7B, different shaped jaw supports may be used. Certain shapes may be more suitable for some applications or purposes than others. A straight first jaw support 113*a* and straight second jaw support 126*a* as shown in FIGS. 2A to 3B may be used, for example, to keep a user's mouth open during medical examinations. The lack of an arched shape more readily allows visual examination of inside the user's mouth on either side of the straight supports. An arched first jaw support 113 and arched second jaw support 126 as shown in FIGS. 4A to 5B may provide improved support than the straight supports during a user's daily stretches, and an extended arched first jaw support 113*b* and an extended arched jaw support 126*b* as shown in FIGS. 6A to 7B may be most appropriate for use by users with a more limited ability to open their mouth (i.e. a more severe case of trismus). According to further embodiments, mini-sized embodiments for each of different shaped jaw supports, which may also reduce the length of the extension of the associated jaw support frames, may also be employed. Parts 104*a*, 105*a*, 112*a*, 113*a*, 118*a*, 120*a*, 122*a*, 124*a*, 125*a*, 126*a*, 153*a*, and 154*a* in the straight shape correspond to parts 104, 105, 112, 113, 118, 120, 122, 124, 125, 126, 153, and 154 in the arched shape and to parts 104*b*, 105*b*, 112*b*, 113*b*, 118*b*, 120*b*, 122*b*, 124*b*, 125*b*, 126*b*, 153*b*, and 154*b* in the extended arched shape.

According to an embodiment as shown in FIGS. 11A to 11E, bite pads 146, 147, and 148, molded to the shape of the corresponding jaw support, may be used to increase comfort for the teeth of a user. Bite pads 146, 147 and 148 are optional, but may be preferred by users that have sensitive teeth, users that have teeth that do not line up properly, or users whose dentist may recommend use of bite pads 146, 147 or 148. A pair of straight jaw support bite pads 146 may consist of a top bite pad 146*a* and a bottom bite pad 146*b* which may be used on the first straight jaw support 126*a* and a second straight jaw support bite pad 146*b* may be used on the second straight jaw support 113*a*. Further, an arched jaw support bite pad 148*a* may be used on the arched first jaw support 126 and an arched second jaw support bite pad 148*b* may be used on the arched second jaw support 113. In addition, an extended arched jaw support bite pad 147*a* may be used on the extended arched first jaw support 126*b* and an extended arched second jaw support bite pad 147*b* may be used on the extended arched second jaw support 113*b*. According to an embodiment, the bite pads 146, 147, and 148 may be installed onto the jaw supports by snapping them in through placing a protrusion, such as rear stoppers 153 and 154, through an opening in the bite pad 148, such as opening 158. According to an embodiment, a tab 159 may be provided on the bite pad 148 to visually indicate which side of the bite pad 148 should face inward towards to other bite pad in the pair. According to an embodiment, rear stoppers 153 and 154 may also make it easier for the user to retain the jaw exerciser in their mouth during stretches and therefore may allow for substantial hands-free operation of the jaw exerciser.

Figure 14:
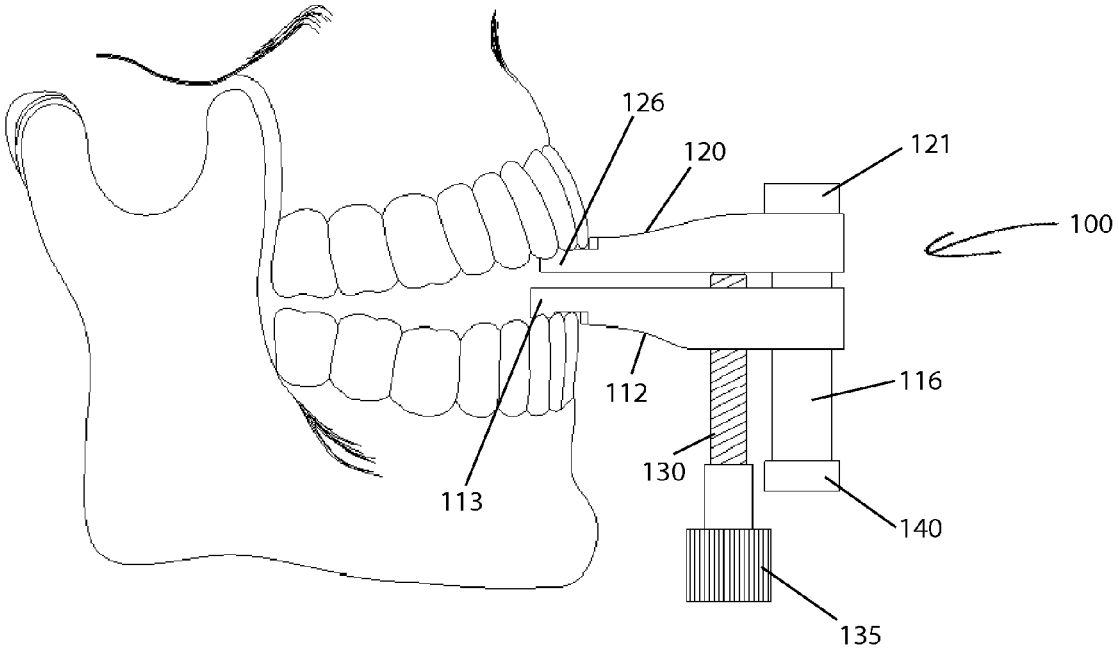
FIG. 14 is a right side view of a jaw exerciser according to an embodiment shown deployed in a model of a human jaw classified as normal bite.
Figure 15:
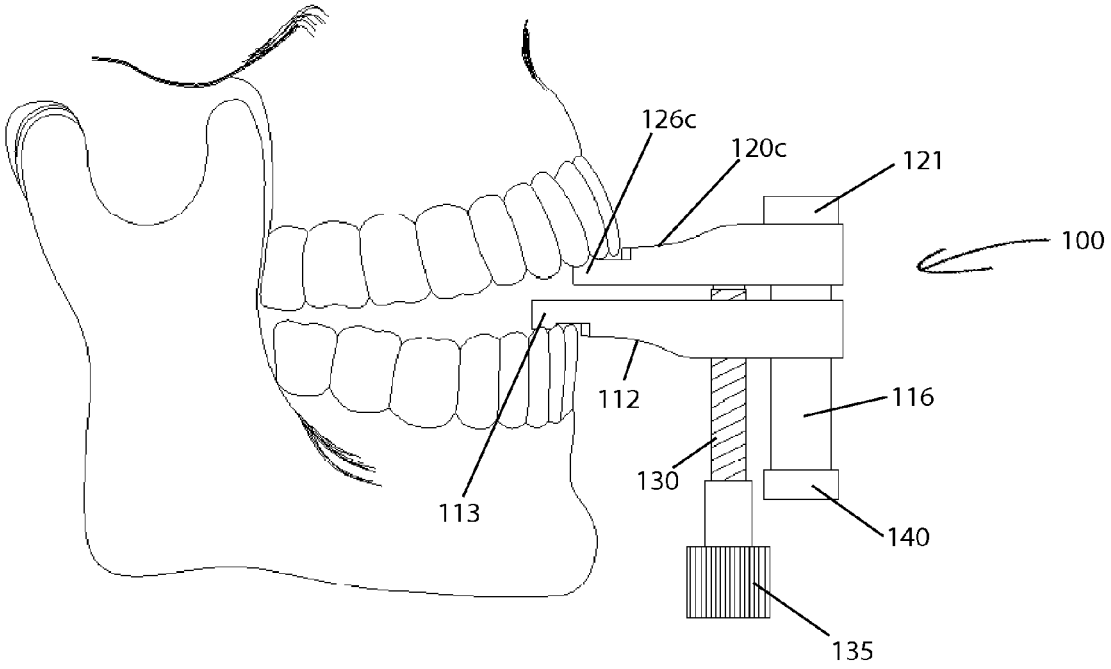
FIG. 15 is a right side view of a further embodiment of the jaw exerciser configured for users with overbites shown deployed in a model of a human jaw with an overbite.
Figure 16:
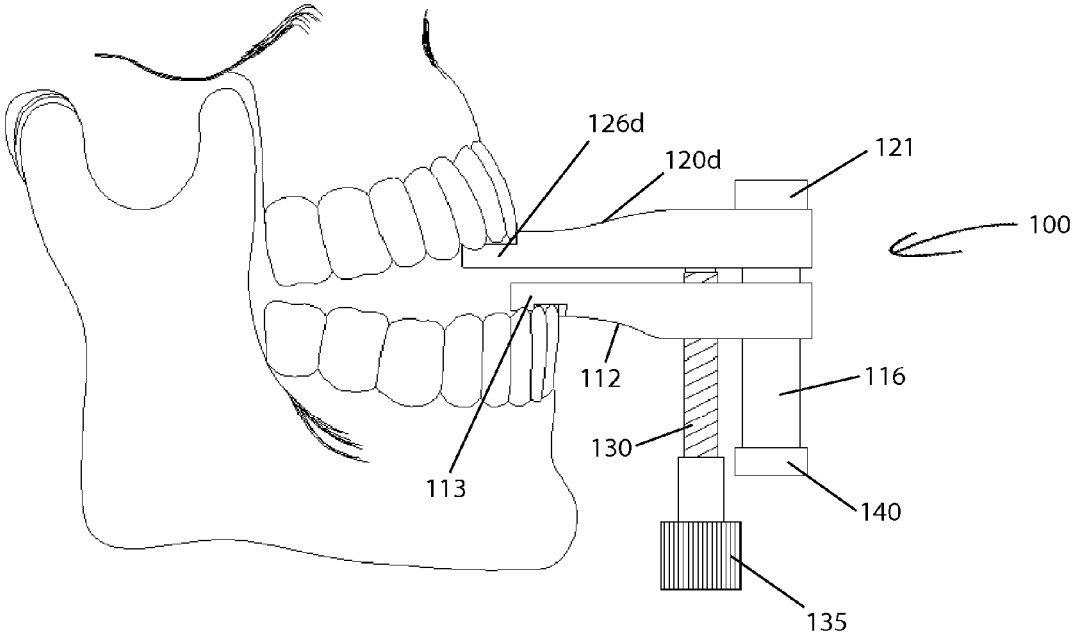
FIG. 16 is a right side view of a further embodiment of the jaw exerciser configured for users with underbites shown deployed in a model of a human jaw with an underbite.

As shown in FIGS. 14, 15 and 16, the manner in which the upper and lower teeth come together may differ for users with an underbite (where the user's lower jaw protrudes) or an overbite (where the user's upper jaw and teeth significantly extend past their bottom jaw and teeth), in comparison to a normal bite. An embodiment for a normal bite is shown in FIG. 14, in which the first jaw support frame 120 extends just a bit less than the second jaw support frame 112 to suitably position first jaw support 113 relative to second jaw support 113 to accommodate a normal bite. According to an embodiment as shown in FIG. 15, the first jaw support frame 120*c* including first jaw support 126*c* may extend a shorter distance than in the embodiment shown in FIG. 14 in order to accommodate users with an overbite. As shown in FIG. 16, the first jaw support frame 120*d* including first jaw support 126*d* may extend a greater distance than in the embodiment shown in FIG. 14 in order to accommodate users with an underbite.

The shaft 116, the first jaw support frame 120, the second jaw support frame 112, the distance adjuster such as jack screw 130, and the retaining screw 140 may be constructed from materials which provide sufficient mechanical strength and rigidity for use in holding the jaw of a user open when the device is used as a jaw exerciser. According to an embodiment, the aforementioned components may be made of plastic, such as injection molded plastic. In other embodiments, the aforementioned components may include plastics such as polypropylene or polystyrene, composites, or a combination of suitable materials. According to an embodiment, the aforementioned components may be made from plastic using a 3D printer.

The bite pads 146, 147 and 148 may be constructed from materials which may enhance comfort for the teeth of a user when the device is used as a jaw exerciser. According to an embodiment, the bite pads 146, 147, and 148 may be made of foam, rubber or any other suitable material known to a skilled person that would provide increased comfort to the teeth of the user.

According to an embodiment as shown in FIG. 1, the jaw exerciser 100 may be assembled and disassembled by a user with relative ease. According to an embodiment, to assemble the jaw exerciser 100, the user places the open end of shaft 116 through hole 124 of the first jaw support frame 120 and then through hole 125 of the second jaw support frame 112. The user may then insert the retaining screw 140 into the complementary receiving recess such as a threaded hole 119 in the open end of the shaft 116. The user may then slide the second jaw support frame 112 up the shaft 116 thereby moving the first and second jaw supports 126 and 113 to the closed position where they are adjacent to each other.

The distance adjuster, such as jack screw 130, is then inserted through a hole which may be threaded such as threaded hole 118 in the second jaw support frame 112 and turned using a knob 135 at the top of the jack screw 130 until it engages a complementary recess such as recess 122 for receiving the jack screw 130 in the first jaw support frame 120. The jack screw 130 may then be further turned to lower the second jaw support frame 112 including the second jaw support 113 by the jack screw 130 pushing the second jaw support frame 112 away from the first jaw support frame 120 including the first jaw support 126. While in use in a user's mouth, the distance between the first jaw support 126 and the second jaw support 113 may be further adjusted using only one hand by turning the jack screw 130 clockwise or counterclockwise using the knob 135 and, if reducing the distance between the jaw supports, pushing upwards on the adjustable second jaw support frame 112.

According to an embodiment, disassembly of the jaw exerciser 100 may be accomplished by unscrewing the jack screw 130 and disengaging it from the first jaw support frame 120 and then from the second jaw support frame 112, unscrewing the retaining screw 140, and sliding the second jaw support frame 112 and then the first jaw support frame 120 off the open end of the shaft 116 so as to disengage it. Shaft 116, first jaw support frame 120, second jaw support frame 113, jack screw 130 and retaining screw 140 of the jaw exerciser 100 may then be transported and reassembled as desired by the user.

According to an embodiment, in use, the jaw exerciser 100 may be inserted into the user's mouth where the first jaw support 126 and second jaw support 113 are at a distance between each other where the user's mouth opens to a comfortable level. The user may then hold that stretch for a first period of time, such as 20 seconds, and then reduce the distance between the first jaw support 126 and the second jaw support 113 for a second period of time, such as 20 seconds, as a rest period, and then repeat the process by increasing the distance between the first jaw support 126 and the second jaw support 113 to the original distance, for a session of alternating stretches and rest periods for an appropriate duration, for example, 15 minutes.

A further exercise regimen, which may be more appropriate for experienced users, may involve inserting the jaw exerciser 100 into the user's mouth where the first jaw support 126 and second jaw support 113 are at a distance between each other where the user's mouth opens to a comfortable level and holding that stretch for a longer duration, such as 5 minutes. After 5 minutes, the distance between the first jaw support 126 and second jaw support 113 may be increased and the stretch held for another 5 minutes. This process may then repeat twice more for a total exercise time of 20 minutes. Other jaw exercise regimens may be designed and used as appropriate for the particular user or as may be recommended for rehabilitation by a healthcare professional.

It is recommended that the user wash the jaw exerciser 100 with soap, such as dish soap, and water prior to first use, and after subsequent uses.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A portable jaw exerciser, capable of being assembled and disassembled for use by a user, consisting of:

a shaft;

a first jaw support frame in sliding frictional engagement with the shaft and extending substantially perpendicularly to the shaft, the first jaw support frame including a first jaw support;

a second jaw support frame in sliding frictional engagement with the shaft and extending substantially perpendicularly to the shaft, the second jaw support frame including a second jaw support;

a distance adjuster received by the first jaw support frame and engaging the second jaw support frame so as to be substantially parallel to the shaft, the distance adjuster being configured to adjust a distance between the first jaw support and the second jaw support; and a removable retaining screw;

wherein the shaft has a threaded hole for receiving the removable retaining screw at an open end of the shaft, the open end of the shaft for receiving the first jaw support frame and the second jaw support frame onto the shaft prior to inserting the removable retaining screw; and wherein the shaft, first jaw support frame, second jaw support frame, distance adjuster and removable retaining screw are adapted to be assembled into the portable jaw exerciser and disassembled such that each of the shaft, first jaw support frame, second jaw support frame, distance adjustor and removable retaining screw are adapted to fit within the user's pocket.

2. A portable jaw exerciser, capable of being assembled and disassembled for use by a user, consisting of:

a shaft;

a first jaw support frame in sliding frictional engagement with the shaft and extending substantially perpendicularly to the shaft, the first jaw support frame including a first jaw support;

a second jaw support frame in sliding frictional engagement with the shaft and, extending substantially perpendicularly to the shaft, the second jaw support frame including a second jaw support;

a jack screw received by the first jaw support frame and engaging the second jaw support frame so as to be substantially parallel to the shaft, the jack screw being configured to adjust a distance between the first jaw support and the second jaw support; and a removable retaining screw;

wherein the shaft has a threaded hole for receiving the removable retaining screw at an open end of the shaft and a retaining cap at the opposite end of the shaft, the open end of the shaft for receiving the first jaw support frame and the second jaw support frame onto the shaft prior to inserting the removable retaining screw;

wherein the shaft has a distance scale providing a visual indication of the distance between the first jaw support and second jaw support; and wherein the shaft, first jaw support frame, second jaw support frame, jack screw and removable retaining screw are adapted to be assembled into the portable jaw exerciser and disassembled such that each of the shaft, first jaw support frame, second jaw support frame, jack screw and removable retaining screw are adapted to fit within the user's pocket.

3. A portable jaw exerciser, capable of being assembled and disassembled for use by a user, consisting of:

a shaft;

a first jaw support frame in sliding frictional engagement with the shaft and extending substantially perpendicularly to, the shaft, the first jaw support frame including a first jaw support having a first removable bite pad and a first rear stopper, which engages the first removable bite pad through a hole in the first removable bite pad;

a second jaw support frame in sliding frictional engagement with the shaft and extending substantially perpendicularly to the shaft, the second jaw support frame including a second jaw support having a second removable bite pad and a second rear stopper, which engages the second removable bite pad through a hole in the second removable bite pad;

a jack screw received by the first jaw support frame and engaging the second jaw support frame so as to be substantially parallel to the shaft, the jack screw being configured to adjust a distance between the first jaw support and the second jaw support; and a removable retaining screw;

wherein the shaft has a threaded hole for receiving the removable retaining screw at an open end of the shaft and a retaining cap at the opposite end of the shaft, the open end of the shaft for receiving the first jaw support frame and the second jaw support frame onto the shaft prior to inserting the removable retaining screw;

wherein the shaft has a distance scale providing a visual indication of the distance between the first jaw support and second jaw support; and wherein the shaft, first jaw support frame, second jaw support frame, jack screw and removable retaining screw are adapted to be assembled into the portable jaw exerciser and disassembled such that each of the shaft, first jaw support frame, second jaw support frame, jack screw and removable retaining screw are adapted to fit within the user's pocket.

* * * * *